US008016027B2

(12) United States Patent
Boyles

(10) Patent No.: US 8,016,027 B2
(45) Date of Patent: Sep. 13, 2011

(54) APPARATUS FOR DRIVING ROTATING DOWN HOLE PUMPS

(75) Inventor: Greg Boyles, Houston, TX (US)

(73) Assignee: Direct Drivehead, Inc., Houston, TX (US)

( * ) Notice: Subject to any disclaimer, the term of this patent is extended or adjusted under 35 U.S.C. 154(b) by 0 days.

(21) Appl. No.: 12/167,405

(22) Filed: Jul. 3, 2008

(65) Prior Publication Data

US 2009/0032240 A1 Feb. 5, 2009

Related U.S. Application Data

(60) Provisional application No. 60/952,601, filed on Jul. 30, 2007.

(51) Int. Cl.
*E21B 43/12* (2006.01)

(52) U.S. Cl. ..... 166/68.5; 166/78.1

(58) Field of Classification Search ..... 166/68.5, 166/78.1; 417/904
See application file for complete search history.

(56) References Cited

U.S. PATENT DOCUMENTS

| | | | | |
|---|---|---|---|---|
| 4,372,379 | A * | 2/1983 | Kulhanek et al. | 166/68.5 |
| 4,716,961 | A | 1/1988 | Makins, Jr. et al. | |
| 5,327,961 | A | 7/1994 | Mills | |
| 5,370,179 | A | 12/1994 | Mills | |
| 5,639,227 | A * | 6/1997 | Mills | 417/423.11 |
| 6,125,931 | A * | 10/2000 | Hult et al. | 166/68.5 |
| 6,289,986 | B1 | 9/2001 | Wright et al. | |
| 6,557,639 | B1 | 5/2003 | Matthews et al. | |
| 6,640,892 | B1 | 11/2003 | Wright | |
| 7,044,215 | B2 | 5/2006 | Boyles | |
| 2001/0050168 | A1 | 12/2001 | Hult | |
| 2003/0131987 | A1 | 7/2003 | Lam et al. | |

* cited by examiner

*Primary Examiner* — Giovanna C Wright
(74) *Attorney, Agent, or Firm* — John A. Thomas

(57) ABSTRACT

An apparatus for rotating down hole pumps has a right angle gear box driving a hollow output shaft. The output shaft is oriented to the vertical and supports and rotates the drive string of a down hole rotary pump. A clamp on the drive string rests on the upper end of the hollow shaft and engages the hollow shaft with a key and keyway arrangement. The hollow shaft of the right angle gearbox is sized to accommodate the drive string, including rod boxes, so that the entire drive string can be pulled through the hollow shaft without dismantling or removing the apparatus.

6 Claims, 3 Drawing Sheets

APPARATUS FOR DRIVING ROTATING DOWN HOLE PUMPS

CLAIM FOR PRIORITY

The present application claims the priority of U.S. provisional application Ser. No. 60/952,601, filed Jul. 30, 2007 and titled "Apparatus for Driving Rotating Down Hole Pumps," which application is incorporated by reference into the present application.

TECHNICAL FIELD

This disclosure relates to the operation of submerged rotating pumps, particularly those used in the petroleum industry to lift fluids from zones of production.

BACKGROUND

Progressive-cavity down-hole pumps are frequently used in the petroleum industry to pump marginal wells. These pumps are typically driven by a motor mounted above the wellhead through a combination of pulleys and belts turning a drive string.

Belt-driven systems present dangers and mechanical problems, such as fast back spin, difficulty in varying the speed of the pulley system, high maintenance cost associated with belt failures, and difficulty in adjusting or replacing belts and pulleys. Ultimately, because of the frequency of belt repairs and adjustments, workers remove belt guards and do not replace them, rendering belt driven devices unsafe. Tens of thousands of dollars on a single well may be lost over time due to the operator's inability to make quick pump-speed adjustments to avoid dry pumping and for other problematic situations associated with belt drives. Common drive heads for rotary pumps also require a separate bearing section that is pressed into the housing of the main support frame for the pump. Further, prior-art pump drivers must be at least partially disassembled in order to allow pulling of the drive string from the well, a great disadvantage because any down time cuts well production.

What is needed is an integral drive head apparatus that incorporates a load-bearing section in the drive head itself, thereby eliminating the need to construct special stand-alone load bearings to support a drive string at different wells, as well as allowing pulling of the drive string without removal of the drive head from the well.

DRAWINGS

DESCRIPTION

In this application, the term "drive string" is intended to include any power conveying linkage of solid or tubular members ("rods") that connect together in threaded sections, or as a continuous string of material, and which may be rotated to power a subsurface mechanism such as an oil pump.

Figure 1:
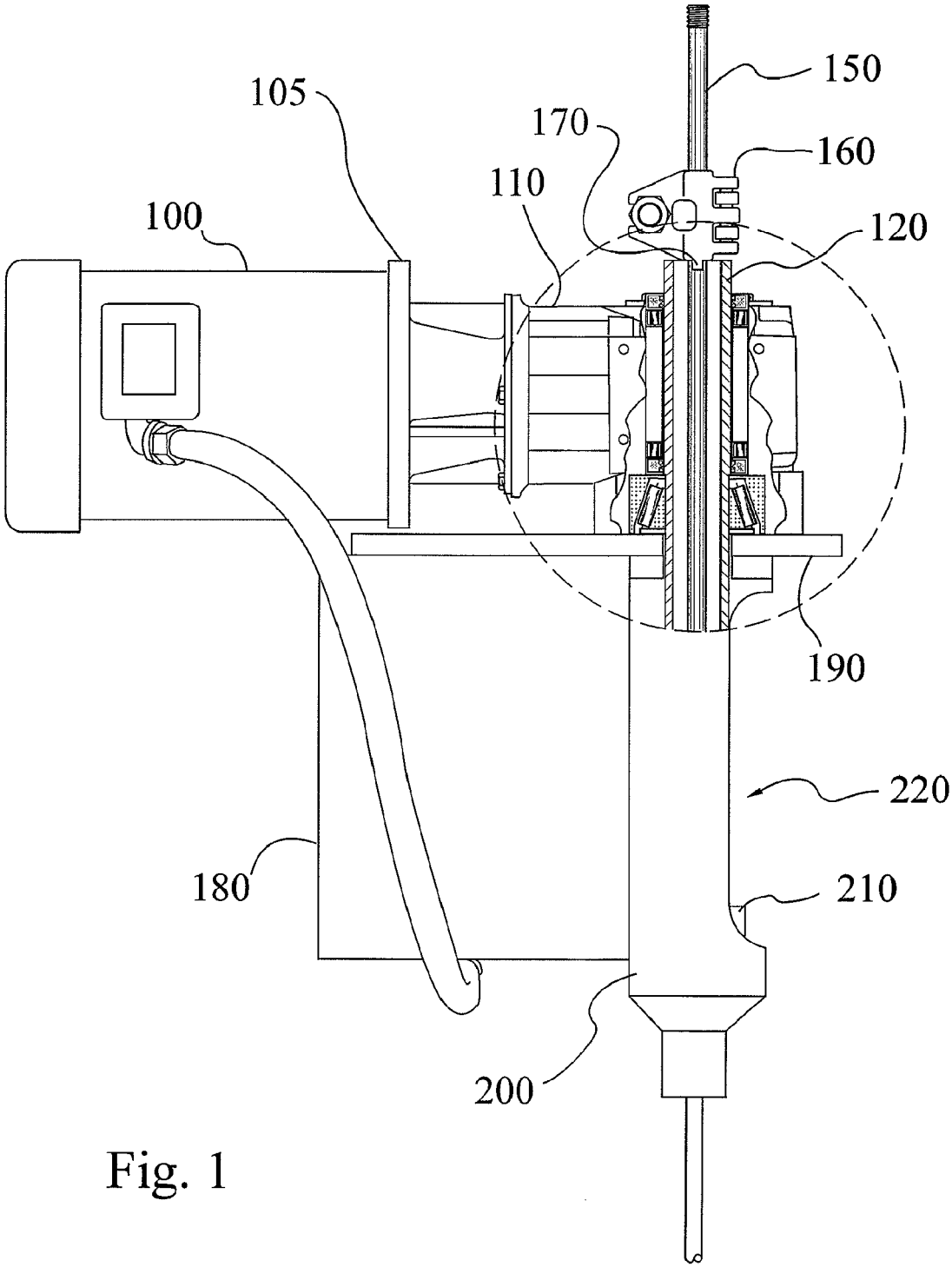
FIG. 1 is a partial cut-away side view of the preferred embodiment, showing the motor and gear supporting a drive string, in this case a polished rod.

FIG. 1 shows an electric motor (100) connected to a right-angle gear drive (110). The electric motor (100) is preferably provided with a flanged NEMA C output face plate (105), and bolted directly to a right-angle double reduction helical gear drive (110) having a construction that supports a standard NEMA C input face plate. A suitable such gear drive (110) is manufactured by Boston Gear Company of Quincy, Mass. In the embodiment disclosed here, the output shaft (120) of the gear drive (110) is modified as discussed below. The motor (100) is preferably controlled by a motor controller (180) connected thereto. A digital phase inverter and motor controller (180) enables the operator to instantly slow the electric motor (100) output up to a maximum of 50% without causing damage to the motor. Suitable controllers are available from Baldor Electric Company of Fort Smith, Ark. The gear ratios of the double reduction helical gear drive (110) serve to slow backspin because the higher the ratio, the greater resistance to back spin. To address higher backspin rates associated with lower gear ratios, a dynamic electronic braking system (not shown) may be added to the electronic motor controller (180) to control backspin. Suitable electronic braking systems are also available from Baldor Electric Company of Fort Smith, Ark.

Figure 2:
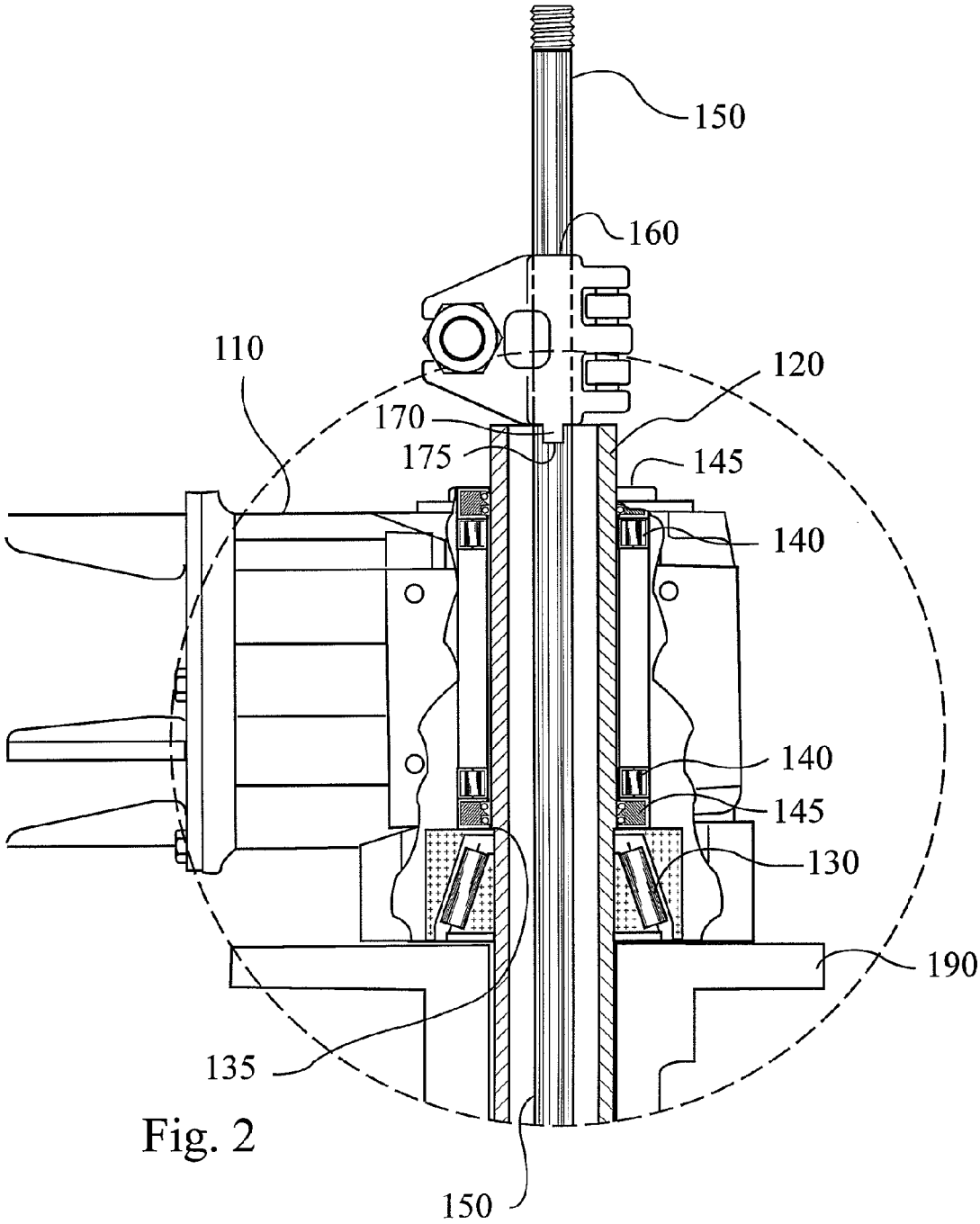
FIG. 2 shows a portion of the partial cut-away view of FIG. 1, enlarged for magnification.
Figure 3:
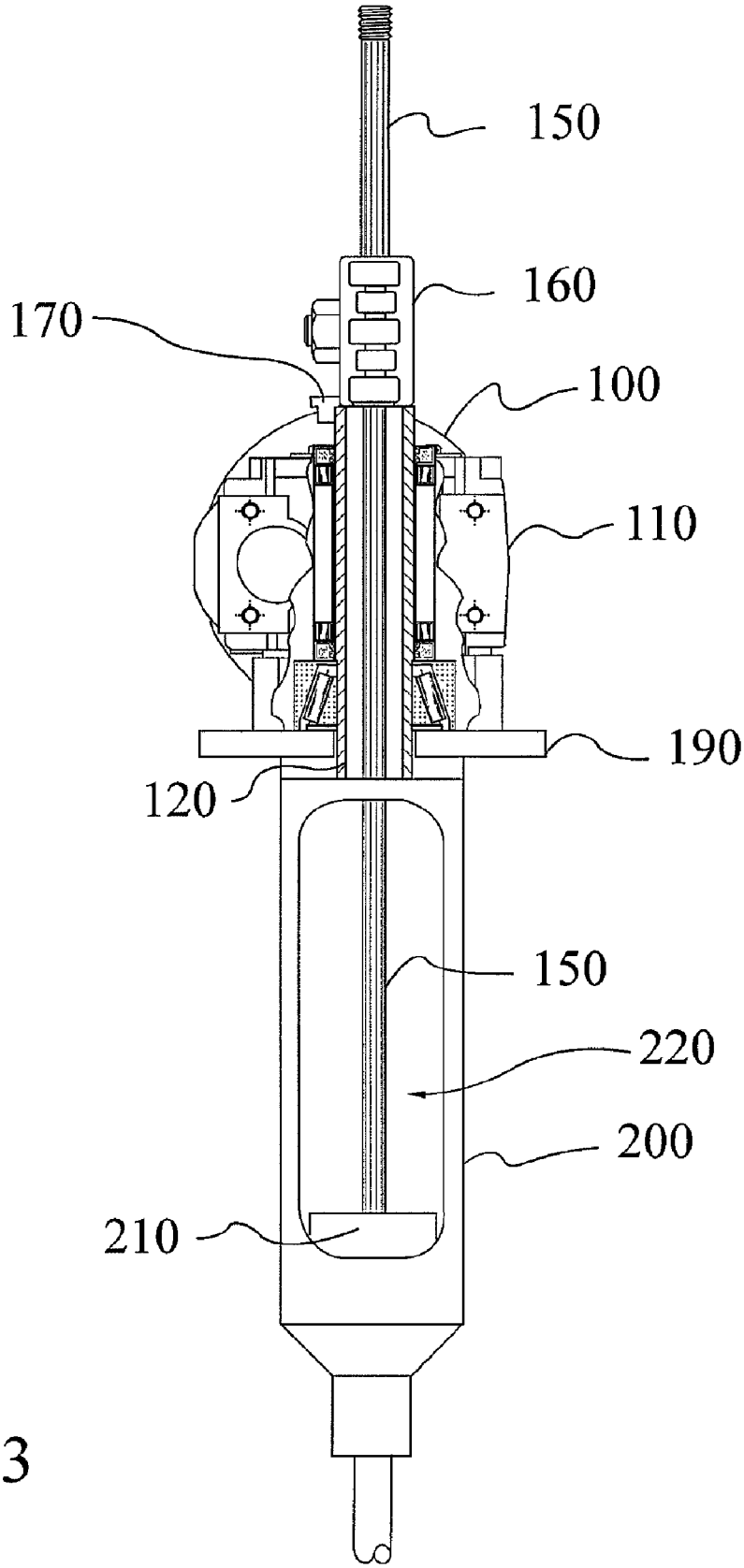
FIG. 3 is a front view of the preferred embodiment.

FIG. 2 is a cut-away view of the gear drive section of the preferred embodiment of the drive head apparatus. The gear drive (110) rotates a hollow output shaft (120). Load bearings (130) running along a race (135) on the output shaft (120) support the output shaft (120). Side bearings (140) stabilize the output shaft (120), and oil seals (145) inside the gear drive (110) keep oil contained within it. The length of the output shaft (120) is made so that the upper end of the output shaft (120) is accessible from outside the gearbox (110).

A drive-string rod (150) connected to the rest of the well rod string (not shown) passes freely through the output shaft (120), and is connected to a clamp (160) above the output shaft (120). Depending on the installation, the drive-string rod (150) may be a section of the sucker rods making up the drive string, or, it may be a polished rod connected to sucker rod or tubing making up the rest of the drive string. The clamp (160) in this embodiment has at least one key (170) that engages a corresponding keyway (175) in the upper end of the output shaft (120), thus transferring torque from the output shaft (120) to the rod (150). Two keys (170) and corresponding keyways (175) may be used where the torque transferred would justify the additional strength. Equivalently, the keyway (175) in the output shaft (120) could be made large enough to accommodate the narrow dimension of the clamp (160) body, so that the clamp (160) acts as a key (170).

The inside diameter of the hollow output shaft (120) is sized to accommodate the largest diameter of rod box (i.e., a connection joint) expected to be encountered in the application. As a result, the connection of the rod (150) of the drive string through the hollow output shaft (120) has the advantage that the entire drive string may be pulled from the well through the hollow output shaft (120) without removing any portion of the drive head apparatus from the rod housing (200). A still further advantage is that the rod (150) passing through the hollow output shaft need not be a polished rod, since sealing against well pressure can be provided elsewhere along the string.

The motor controller (180) and the housing (200) are attached to and supported by a support plate (190). As shown in the figures, the housing (200) of the preferred embodiment supports a polished rod stuffing box (210), if present at this point, and has an opening (220) for easy access. In other embodiments, the housing (200) may incorporate a combined stuffing box (210), rod blowout preventer (not shown), and pumping tee assembly (not shown). The housing (200) connects to, and is supported by, a wellhead (not shown). By machining all components into one piece, the need for additional nipples, flanges, tees, and or separate devices below the motor (100) and gear drive (110) section can be eliminated. This lowers the drive head profile and also provides the operator with a means of controlling a well while the rods are pulled in case of a blowout, or to replace the packing in the stuffing box in a flowing well scenario.

More details on motor control may be found in the disclosure of U.S. Pat. No. 7,044,215 B2, which is incorporated into this application by reference.

Since those skilled in the art can modify the specific embodiments described above, I intend that the claims be interpreted to cover such modifications and equivalents.

I claim:

1. An apparatus for rotating down hole pumps, comprising:

a right angle gear box;

the right angle gear box having a single hollow output shaft;

the single hollow output shaft oriented substantially to the vertical;

the single hollow output shaft having an upper end;

the upper end of the single hollow output shaft accessible outside the right angle gearbox;

the upper end of the single hollow output shaft having a keyway for engaging a key;

the single hollow output shaft having an inside diameter sized to freely pass therethrough a drive string comprising polished rods and rod boxes;

a removable clamp; the clamp having a key capable of engaging the keyway of the single hollow output shaft;

the clamp grasping the drive string, so that the drive string is suspended from the single hollow output shaft; and, whereby, the drive string is rotated when the single hollow output shaft rotates.

2. The apparatus of claim 1, further comprising:

the single hollow output shaft further comprising a second keyway; and, the clamp further comprising a second key for engaging the second keyway.

3. The apparatus of claim 1, further comprising:

a motor connected to the input of the right angle gear box to cause rotation of the single hollow output shaft.

4. The apparatus of claim 3, where the motor is an electric motor.

5. The apparatus of claim 4, further comprising:

an electronic motor controller operably connected to the electric motor.

6. The apparatus of claim 1, further comprising:

a support plate supporting the right angle gear box;

a housing for the drive string; and, the housing supporting the support plate.

* * * * *